United States Patent [19]

Hartmann et al.

[11] 3,968,835

[45] July 13, 1976

[54] HEAT EXCHANGER FOR OIL DEODORIZING PLANT

[75] Inventors: Albert Hartmann, Heusenstamm; Herbert Schilken, Friedberg; Bernhard Romeiser, Hanau, all of Germany

[73] Assignee: Metallgesellschaft Aktiengesellschaft, Frankfurt am Main, Germany

[22] Filed: July 15, 1974

[21] Appl. No.: 488,801

[30] Foreign Application Priority Data

July 18, 1973 Germany ..... 2336632

[52] U.S. Cl. ..... 165/108; 122/37; 165/106; 165/109; 165/164

[51] Int. Cl.[2] ..... F28F 13/06

[58] Field of Search ..... 165/108, 109, 106, 164, 165/166, 167, 168, 169, 170, 158, 159, 160; 122/37

[56] References Cited

UNITED STATES PATENTS

| | | | |
|---|---|---|---|
| 131,325 | 9/1872 | Bauer | 165/109 |
| 1,037,029 | 8/1912 | Lukacs | 122/37 |
| 1,119,391 | 12/1914 | Becker | 122/37 |
| 1,285,916 | 11/1918 | Bradburn | 165/164 |
| 2,544,183 | 3/1951 | Rogers | 165/108 |
| 3,517,732 | 6/1970 | Brebant | 165/108 |
| 3,615,079 | 10/1971 | DeLara | 165/108 |
| 3,642,452 | 2/1972 | Roget | 165/108 |

FOREIGN PATENTS OR APPLICATIONS

| | | | |
|---|---|---|---|
| 542,906 | 5/1956 | Italy | 165/108 |
| 486,435 | 6/1938 | United Kingdom | 165/106 |
| 14,835 | 1/1905 | United Kingdom | 165/108 |

*Primary Examiner*—Charles J. Myhre
*Assistant Examiner*—Daniel J. O'Connor
*Attorney, Agent, or Firm*—Karl F. Ross; Herbert Dubno

[57] ABSTRACT

A pair of chambers each containing a body of liquid are separated by a single heat-conducting partition wall. A guide wall is parallel to and spaced from each side of the partition wall and steam is bubbled up between the two walls to recirculate the liquids in the chambers and thereby effect heat exchange through the wall. The liquid in the hotter chamber is recovered from a downstream stage of an oil deodorizing process. Baffles are provided above the gap between the guide walls and the partition wall to aid in fluid circulation.

6 Claims, 5 Drawing Figures

HEAT EXCHANGER FOR OIL DEODORIZING PLANT

FIELD OF THE INVENTION

This invention relates to a heat exchanger. More particularly the present invention concerns a heat exchanger for the purification and deodorization of oil.

BACKGROUND OF THE INVENTION

In the production of edible oils and fats the oil is refined and the neutralized and bleached oil is subsequently supplied to a deodorizing stage in which the undesired flavoring and factory substances are removed. These substances consist mainly of alcohols, ketones, aldehydes and low-molecular weight fatty acids and, more recently, also of traces of chlorine-containing pesticides.

The impurities are usually steam distilled at elevated temperature and under reduced pressure in a closed apparatus. Such a process has been described in Chemikerzeitung 88, pages 412 et seq.

The process can be carried out as a batch process, a semicontinuous process or a continuous process (Fette, Seifen, Anstrichmittel 72, pages 166 et seq., 1970).

It has been attempted to improve the semicontinuous process by continuously feeding the product to the first stage of the plant and continuously discharging the product from the last stage whereas the intervening stages are intermittently operated in alternation. This practice allows direct heat exchange in a separate heat exchanger between the hot product as it is discharged and the cold product as it is fed. Such a procedure has the disadvantage that owing to the continuous feeding and discharge the treating time of the oil in the first and last stages is not uniform. Here too, portions of the oil are treated for a longer of shorter time. A restriction is also involved in the requirement that one and the same product must be processed for long periods of time and there is no frequent change of product. It is also known to design the first stage as a heat exchanger and to heat this stage by a closed heat carrier cycle. In the practice the cooled heat carrier is reheated by the heated product in one of the subsequent stages.

OBJECTS OF THE INVENTION

It is an object of the invention to provide an improved heat exchanger which enables a high heat transfer rate and can cooperate with deodorizers but is not restricted to such use.

Another object is the provision of an improved method of operating a heat exchanger.

SUMMARY OF THE INVENTION

These objects are accomplished in that the chambers are provided with recirculating means which act along the partition separating them and serve to recirculate the hot and cool liquids. In such a heat exchanger at least one guide for the recirculated liquid is provided and is spaced from the partition. This improves the recirculation and heat transfer.

According to a desirable feature, the mean distance between the partition and the guide plate is adjustable so that optimum conditions can be adjusted, e.g., in dependence on the pressure and nature of the recirculating fluid. The recirculating fluid may be steam, or a gaseous recirculating fluid, e.g., an insert gas.

The effectiveness of the heat exchanger may be improved by a suitable form and succession of the chambers for hot and cool liquids. The chambers can consist of sectors or rings arranged in the, for instance, circular cross-section of the heat exchanger. Chambers in a checkerboard pattern may be used in a heat exchanger which is square or rectangular in cross-section.

The heat exchanger according to the invention will be particularly suitable as stage I of a deodorizer, as explained hereinafter. The recirculating fluid consists in that case of propelling steam. This has the advantage that the heat exchange carried out in a partial vacuum is accompanied by a degasification and drying of the liquid and by a simultaneous predeodorization of the feed product and an additional deodorization of the product which has been pumped off. The heat exchanger results in a simple and fast heat transfer between hot and cold fluids during a defined residence time. The residence time is highly significant for the quality and stability of the products being treated, which consist in most cases of oils or fats.

BRIEF DESCRIPTION OF THE DRAWING

The above and other objects, features, and advantages will become more readily apparent from the following reference being made to the drawing in which.

Figure 1:
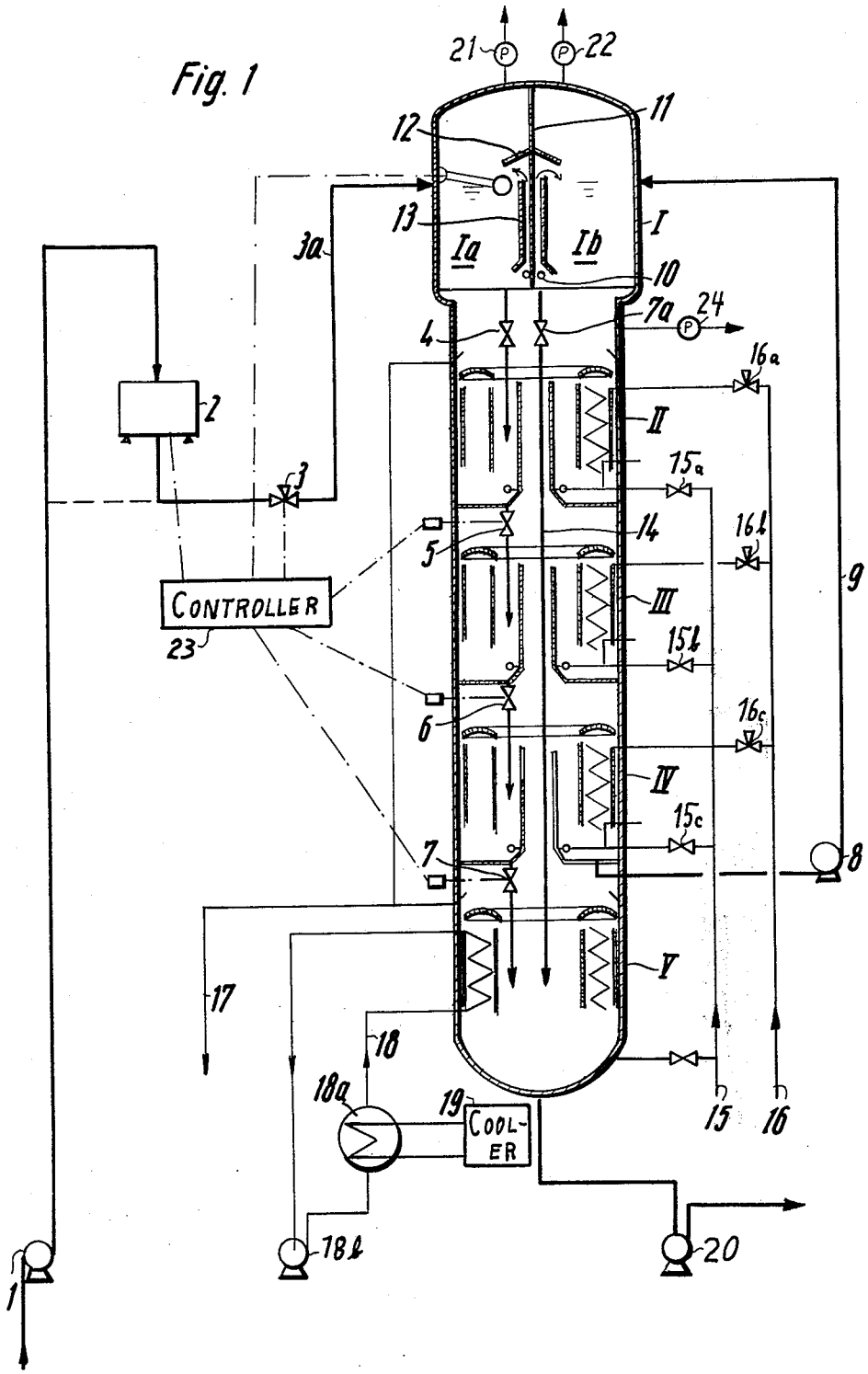
FIG. 1 is a flow scheme showing a deodorizer.

In the following description, the heat exchanger is also referred to as stage I of the deodorizer.

The refined product, which is at or slightly above room temperature (e.g. 25° C), is fed in through conduit 1 by a pump 1*a* to a container or reservoir 2, from which a measured charge is fed periodically through a valve 3 and a conduit 3*a* to the heat exchange stage I of the deodorizer until a closed inlet chamber I*a* of stage I is filled. Alternatively, the feeding may be direct and may be controlled by a level control contact and float 3*b* in stage I. The product is then subjected to heat exchange with a hot charge, from stage IV of the deodorizer. After such heat exchange, which will be described hereinafter, the heated product flows through a valve 4 into the next stage II and after the treatment in stage II flows through valve 5 into a stage IA disposed underneath, then through valves 6 and 7 into stages IV and V, respectively. The valves 3 – 7 are all operated according to a program by a controller 23.

Before the product enters the lowermost stage V, it is pumped back by a glandless pump 8 through a conduit 9 into a separate cooling chamber I*b* of stage I, in which the now hot pretreated product from stage IV is subjected for a period predetermined to heat exchange with additionally fed product in chamber I*a*.

To intensify the heat exchange, propelling steam under a pressure of 0.5 kg/an$^2$ gauge emerges from conduits 10*a* through nozzle tubes 10. To recirculate the oil, the steam flows upwardly along the partition or partitions 11 in a gap ll*a*, which is defined by the partition or partitions 11 and guide plates 13. The partition or partitions 11 are provided with swirling and deflecting plates 12. This recirculation is induced in both chambers I*a* and I*b*. After a predetermined residence time and when the fed oil or fat has been heated, the cooled product in chamber I*a* flows through valve 7*a* and conduit 14 directly into the last stage V. This is a cooling stage, in which the oil is cooled to about 100° C. by indirect heat exchange with recirculated cooling water.

In the several stages II-V, the oil is deodorized by a supply of direct steam from conduit 15 through valves 15- c. To heat the oil to the end temperature of 200° – 270° C., depending on the kind of oil or fat, superheated steam is fed through conduit 16 and valves 16*a* – *c* into stages II to IV.

In stages II to V the oil is treated with steam from steam sprayers and by oil recirculators operating as gas-lift pumps. The heating and cooling systems are built in the recirculators. The upper portion of each stage contains collectors 17*a*, for collecting splashed oil from the water vapor laden vapor. These collectors prevent a backflow of condensation products from the upper part of each stage into the deodorized oil or fat. The splashed oil is discharged through conduit 17.

Chamber I*a* is not connected to the same high vacuum as chamber I*b* and the remaining stages, but to a somewhat lower vacuum pumps 21 and 21 serving to evacuate these chambers. This has the advantage that the vacuum fluctuations which may occur here, e.g., in case of a feeding of moist product, are not transmitted to the remaining stages so that the vacuum created in the remaining stages by pumps 24 is not disturbed.

A closed cooling cycle 18 is provided for the precooling of the oil or fat in the last stage V. In this case, e.g., condensate is recirculated through the cooling system of the last stage and is recooled by water from a cooler 19 in an external plate-type cooler 18*a*. This prevents a formation of deposits by precipitated minerals.

Figure 2A:
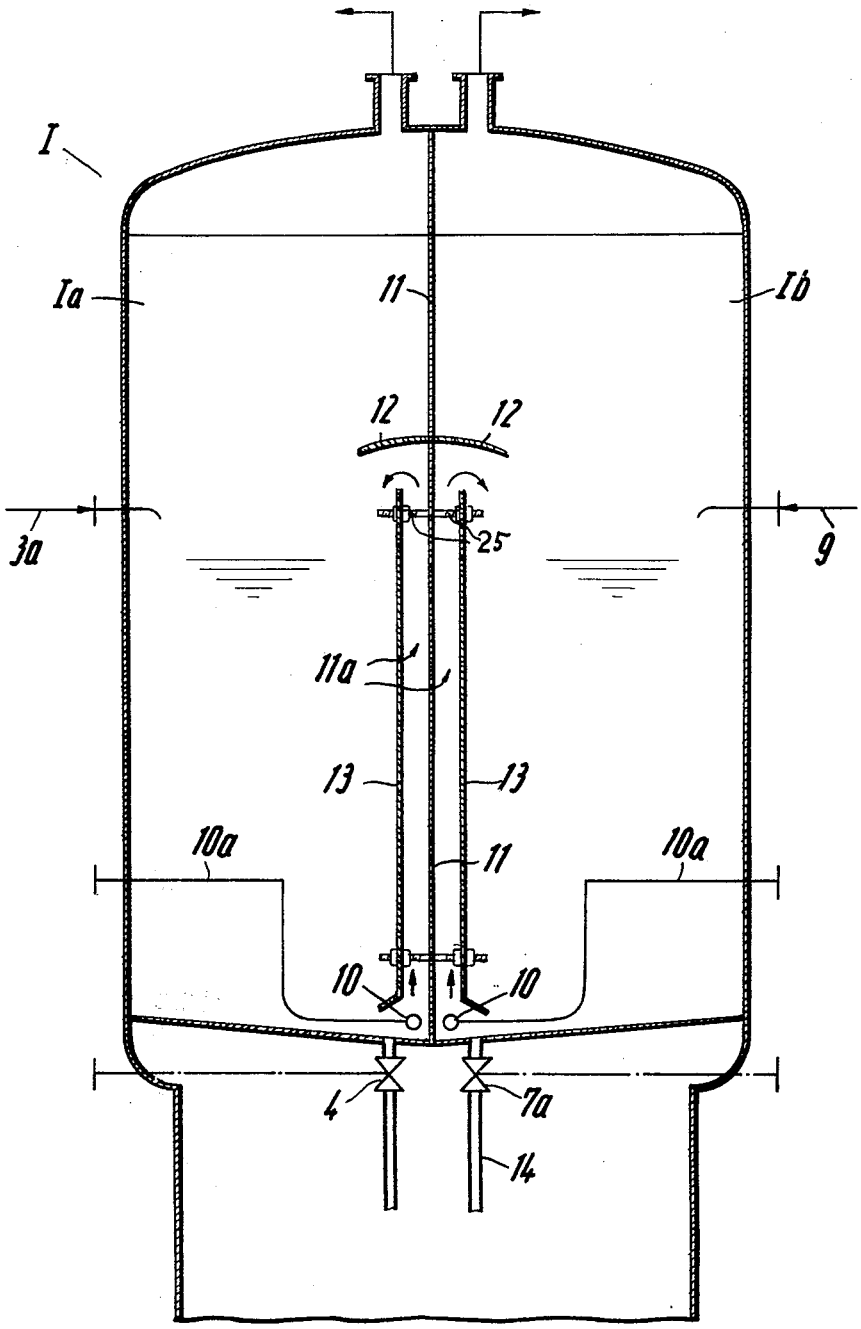
FIG. 2 is an enlarged longitudinal sectional view taken through the heat exchanger of the deodorizer of FIG. 1.
FIGS. 2*b*, 2*c*, and 2*d* are cross-sectional views showing different embodiments of the heat exchanger.
Figure 2B:
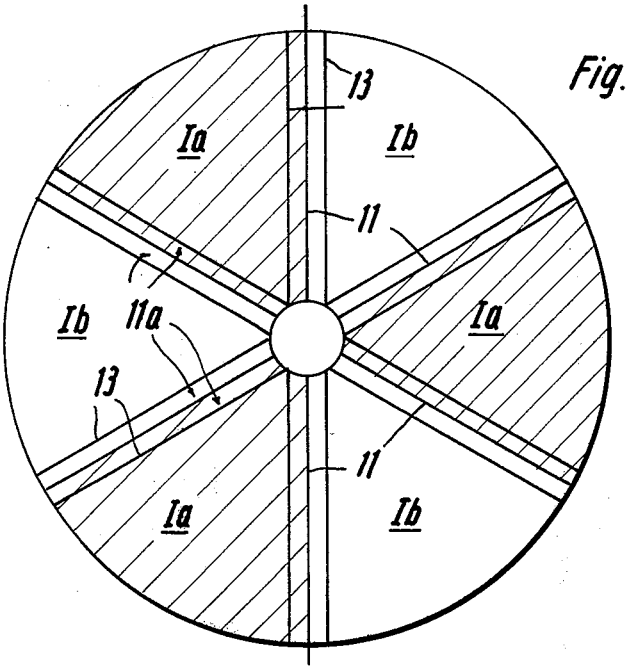
Figure 2C:
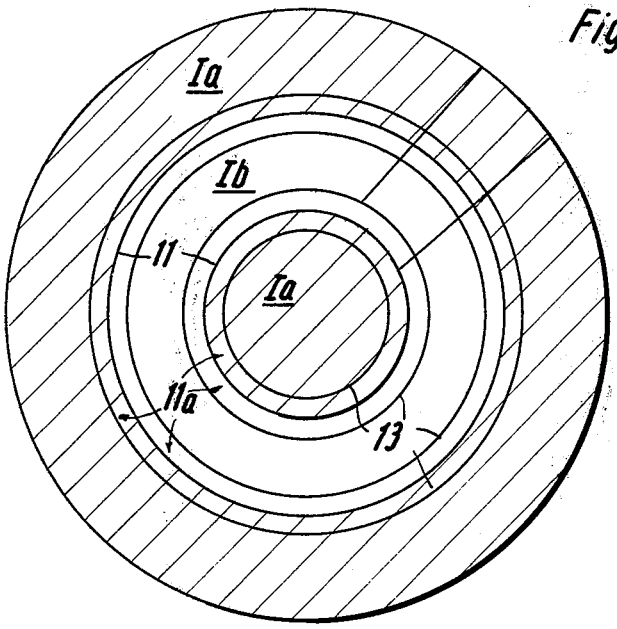
Figure 2D:
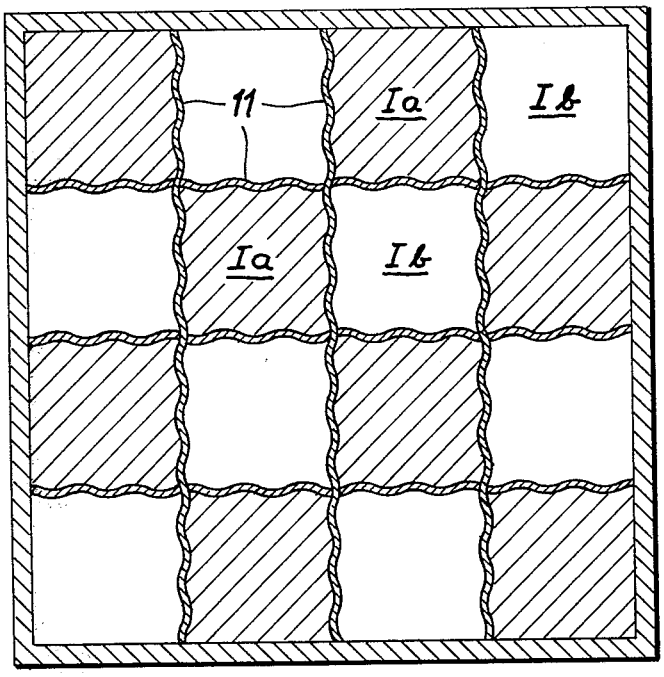

To further improve the heat exchange, stage I is desirably divided into a plurality of sections, which may have the form of wedge like sectors of a circle as shown in FIG. 2*b* or of concentric rings as shown in FIG. 2*c*, or as checkerboard squares as in FIG. 2*d*. The inlet chambers I*a* are hatched and may be jointly filled and emptied, just as the cooling chambers I*b*. The partitions 11 between adjacent sections may be straight plates as shown in FIGS. 2*b* and 2*c* or may be corrugated plates as in FIG. 2*d* to improve the heat transfer. The guide plates 13 which are parallel thereto are arranged with such spacing that in conjunction with the propelling steam they result in an optimum recirculation throughout the section.

The nozzle tubes 10 (not shown in FIGS. 2*a* and 2*b*) consist of tubes which are provided at the top with holes. Other types of nozzles may be used to force the recirculating propelling steam into the gaps 11*a*.

Departing from the showing in FIG. 1, stage I may be more or less separate from the remaining apparatus. Also the guide plates 13 may be mounted on screws 25 to allow adjustment of the spacing between plates 11 and 13.

The procedure according to the invention results in a simple and economic heat exchange in conjunction with a defined residence time in the first stage, and the recirculation of the oil results in a drying, heating and predeodorization of the feed oil and in an additional deodorization in the first stage of the product pumped from the fifth stage into the first stage. The heat exchange in the stages in highly intense and k-values up to 100 kcal/m² h °C. are reached.

EXAMPLE 1

From the measuring container 2, a charge of pretreated peanut oil at a temperature of 50° C is sucked into the chamber I*a* of stage I. That chamber is under a residual pressure of about 30 millimeters mercury. At the same time, a soybean oil charge which has been deodorized in stages II, III and IV is pumped at a temperature of 240° C. from stage IV of the deodorizer into the chamber I*b* of stage I. The remaining stages of the deodorizer and the chamber I*b* of stage I are under a residual pressure of about 4 millimeters mercury (about 4 Torr). Within stage I, the two different oil charges are recirculated at high velocity along the partitions by direct steam injected under a pressure Of 3 kg/am² gauge. As a result, the peanut oil in the chamber I*a* is heated to 140° C., and the soybean oil in the chamber I*b* is cooled from 240° C. to 150° C.

The residence time in both chambers of stage I corresponds to 0.6–0.8 hour, which is predetermined for all stages of the deodorizer. After this interval time, the two valves 4 and 7*a* connected to the two chambers of stage I are opened (automatically or by hand) and the peanut oil flows at a temperature of 140° C. from the left-hand chamber into stage II, in which it is indirectly heated with steam from 140° C. to the desired deodorizing temperature of 240° C. From the right-hand chamber of stage I, the soybean oil flows at a temperature of 150° C. into stage V, in which it is cooled from 150° C. to about 100° C by means of cooling water.

EXAMPLE 2 (PRIOR ART)

In a deodorizing plant as shown in FIG. 1 and having a capacity of 200 metric tons of oil per day, the heat exchange stage I was omitted and replaced by a normal deodorizing stage such as II-IV. That plant was fed in intervals of 0.8 hours with 30 charges Of 7 metric tons of oil each at a temperature of 50° C. In stages I-IV the oil was heated by means of steam of 40 kilograms per square centimeter above atmospheric pressure from 50° C. to 240° C. and was deodorized at the latter temperature. The deodorized oil was cooled in stage V to about 100° C. with cooling water. 280 kilograms steam for heating and deodorizing were consumed per metric ton of oil.

EXAMPLE 3

For a comparision with Example 2, the same deodorizing plant was used as in Example 2 but the first stage consisted of the heat exchanger such as is shown as stage I in FIGS. 1 and 2*a*.

The oil to be deodorized was heated in stage I from 50° C. to about 140° C. by heat exchange with hot deodorized oil from stage IV, and the latter oil was thus cooled to about 150° c. The recirculation in the heat exchange stage I was effected with propellent steam under a pressure of 3 kilograms per square centimeter above atmospheric pressure. The oil which had been heated in stage I to 140° C. was then heated in stages II to IV with steam at 40 kg/am² gauge to 240° C. and was deodorized at the latter temperature. The deodorized oil which had been cooled from 240° C. to about 150° C. in heat exchange stage I was supplied to the cooling stage V and was cooled there with cooling water to about 100° C.

Compared with Example 2, 115 kilograms steam were saved per metric ton of oil using the system of the present invention. This is proof of the effectiveness of the process of this invention.

We claim:

1. A heat exchanger for a pair of liquids, said exchanger comprising:

a. a generally closed compartment;

b. a heat-conducting partition wall subdividing said compartment into at least a pair of contiguous chambers each holding a respective liquid;

c. means for forming a partial vacuum in said chambers;

d. means in each of said chambers for inducing recirculating liquid flow along the respective side of said partition wall; and e. at least one guide wall in each of said chambers spaced from and generally parallel to the respective side of said partition wall.

2. The heat exchanger defined in claim 1 wherein the last-mentioned means includes nozzle means at the base of said partition wall for injecting a gas into said chambers, thereby bubbling said gas up in said chambers between said partition wall and said guide walls.

3. The heat exchanger defined in claim 1, further comprising a baffle plate in each of said chambers above the gap between said partition wall and the respective guide wall.

4. The heat exchanger defined in claim 1 wherein said walls are generally planar.

5. The heat exchanger defined in claim 1 wherein said walls are generally concentric and annular.

6. A heat exchanger for the exchange of heat between two liquids, said heat exchanger comprising:

a. a closed compartment;

b. means for evacuating said compartment;

c. a plurality of upright partitions in said compartment reaching upwardly from the bottom thereof and subdividing said compartment into a plurality of chambers on opposite sides of said partitions, said chambers containing said liquids in heat-exchanging relationship through said partitions;

d. respective guide plate disposed in each of said chambers in closely spaced relationship with a respective one of the sides of said partitions, said guide plates terminating above and below the bottom and top of said compartment, respectively, to define narrow channels along each of said sides of said partitions; and e. respective gas injectors disposed at the bottom of each of said channels for dispensing a gas into the same to circulate liquid from each compartment upwardly through said channels and along the opposite sides of said partitions.

* * * * *